US007696958B2

(12) United States Patent
Lee

(10) Patent No.: US 7,696,958 B2
(45) Date of Patent: Apr. 13, 2010

(54) PLASMA DISPLAY APPARATUS AND IMAGE PROCESSING METHOD THEREOF

(75) Inventor: Jun Hak Lee, Suwon-si (KR)

(73) Assignee: LG Electronics Inc., Seoul (KR)

( * ) Notice: Subject to any disclaimer, the term of this patent is extended or adjusted under 35 U.S.C. 154(b) by 823 days.

(21) Appl. No.: 11/127,186

(22) Filed: May 12, 2005

(65) Prior Publication Data

US 2005/0253786 A1 Nov. 17, 2005

(30) Foreign Application Priority Data

May 14, 2004 (KR) ..... 10-2004-0034468

(51) Int. Cl.
*G09G 3/28* (2006.01)

(52) U.S. Cl. ..... 345/63

(58) Field of Classification Search ..... 345/63; 315/169.4

See application file for complete search history.

(56) References Cited

U.S. PATENT DOCUMENTS 5,546,101 A * 8/1996 Sugawara ..... 345/63
6,812,936 B2 * 11/2004 Hoppenbrouwers ..... 345/691
6,965,358 B1 * 11/2005 Kasahara et al. ..... 345/63
7,075,243 B2 * 7/2006 Park ..... 315/169.4
7,209,100 B1 * 4/2007 Suzuki ..... 345/63
7,239,295 B2 * 7/2007 Kang et al. ..... 345/63
2003/0169217 A1 * 9/2003 Kang et al. ..... 345/63
2003/0218582 A1 11/2003 Park et al.
2003/0231148 A1 12/2003 Lin et al.
2004/0150588 A1 * 8/2004 Kang et al. ..... 345/63
2005/0073484 A1 * 4/2005 Kim ..... 345/63
2005/0140582 A1 * 6/2005 Lee et al. ..... 345/60
2005/0212727 A1 * 9/2005 Lee ..... 345/63
2005/0275605 A1 * 12/2005 Kwon ..... 345/63
2005/0280608 A1 * 12/2005 Kim et al. ..... 345/63
2006/0012547 A1 * 1/2006 Chang ..... 345/63
2007/0091021 A1 * 4/2007 Uota ..... 345/63

FOREIGN PATENT DOCUMENTS

EP 1353315 A1 10/2003

* cited by examiner

*Primary Examiner*—Amr Awad
*Assistant Examiner*—Tony Davis
(74) *Attorney, Agent, or Firm*—McKenna Long & Aldridge LLP

(57) ABSTRACT

The present invention relates to a plasma display apparatus and image processing method thereof. According to the present invention, the plasma display apparatus includes a scan driving unit and a sustain driving unit which have a sustain driving circuit for allowing a peaking pulse to be included in one sustain pulse so that a plurality of discharges are generated by one sustain pulse when a sustain pulse is supplied to a PDP and predetermined electrodes of the PDP.

10 Claims, 6 Drawing Sheets

| Gray level | Sub-field weight / Sub-field mapping | | | | | | | | | | | | Brightness |
|---|---|---|---|---|---|---|---|---|---|---|---|---|---|
| | 1 | 2 | 3 | 5 | 8 | 13 | 21 | 34 | 48 | 51 | 64 | 69 | |
| 0 | X | X | X | X | X | X | X | X | X | X | X | X | 12r + 0a + 0s |
| 1 | O | X | X | X | X | X | X | X | X | X | X | X | 12r + 1a + 2s |
| 2 | X | O | X | X | X | X | X | X | X | X | X | X | 12r + 1a + 3s |
| 3 | O | O | X | X | X | X | X | X | X | X | X | X | 12r + 2a + 5s |
| 4 | X | X | O | X | X | X | X | X | X | X | X | X | 12r + 1a + 5s |
| ... | | | | | | | | | | | | | |
| 31 | O | O | O | O | O | X | X | X | X | X | X | X | 12r + 5a + 35s |
| 32 | X | X | X | X | X | O | X | X | X | X | X | X | 12r + 1a + 23s |
| 33 | O | X | X | X | X | O | X | X | X | X | X | X | 12r + 2a + 35s |
| ... | | | | | | | | | | | | | |
| 59 | O | O | O | O | O | O | O | O | O | O | O | O | 12r + 12a + 267s |

Fig. 4

Real brightness value measurement table

| | | | |
|---|---|---|---|
| | no addressing + all 0 sustain | 0.42 | cd/m2 |

| | | | | | |
|---|---|---|---|---|---|
| SF1 | 1SF addressing + all 0 sustain | | | 1.3 | address + reset |
| SF2 | 2SF addressing + all 0 sustain | 2.88 | cd/m2 | 2.46 | address + last + reset |
| SF3 | 3SF addressing + all 0 sustain | 2.9 | cd/m2 | 2.48 | address + last + reset |
| SF4 | 4SF addressing + all 0 sustain | 2.9 | cd/m2 | 2.48 | address + last + reset |
| SF5 | 5SF addressing + all 0 sustain | 2.88 | cd/m2 | 2.46 | address + last + reset |
| SF6 | 6SF addressing + all 0 sustain | 2.88 | cd/m2 | 2.46 | address + last + reset |
| SF7 | 7SF addressing + all 0 sustain | 2.88 | cd/m2 | 2.46 | address + last + reset |
| SF8 | 8SF addressing + all 0 sustain | 2.87 | cd/m2 | 2.45 | address + last + reset |
| SF9 | 9SF addressing + all 0 sustain | 2.87 | cd/m2 | 2.45 | address + last + reset |
| SF10 | 10SF addressing + all 0 sustain | 2.86 | cd/m2 | 2.44 | address + last + reset |
| SF11 | 11SF addressing + all 0 sustain | 2.85 | cd/m2 | 2.43 | address + last + reset |
| SF12 | 12SF addressing + all 0 sustain | 1.9 | cd/m2 | 1.48 | address + last |

| | | | | |
|---|---|---|---|---|
| | all addressing + all 0 sustain | 27.8 | cd/m2 | 121 normal_sustain+ 11 1st_sustain+ 11 last sustain+ 12reset |

| | | | | | | | |
|---|---|---|---|---|---|---|---|
| SF1 | all addressing + except 1SF 11sus all 0 sustain | 38.1 | cd/m2 | 10.3 | 1st sustain+ 10Normal sus for SF1 | 0.95 | cd/m2 |
| SF2 | all addressing + except 2SF 11sus all 0 sustain | 38.1 | cd/m2 | 10.3 | 1st sustain+ 10Normal sus for SF2 | 0.95 | cd/m2 |
| SF3 | all addressing + except 3SF 11sus all 0 sustain | 38.1 | cd/m2 | 10.3 | 1st sustain+ 10Normal sus for SF3 | 0.95 | cd/m2 |
| SF4 | all addressing + except 4SF 11sus all 0 sustain | 38.1 | cd/m2 | 10.3 | 1st sustain+ 10Normal sus for SF4 | 0.95 | cd/m2 |
| SF5 | all addressing + except 5SF 11sus all 0 sustain | 38.1 | cd/m2 | 10.3 | 1st sustain+ 10Normal sus for SF5 | 0.95 | cd/m2 |
| SF6 | all addressing + except 6SF 11sus all 0 sustain | 38.1 | cd/m2 | 10.3 | 1st sustain+ 10Normal sus for SF6 | 0.95 | cd/m2 |
| SF7 | all addressing + except 7SF 11sus all 0 sustain | 38.1 | cd/m2 | 10.3 | 1st sustain+ 10Normal sus for SF7 | 0.95 | cd/m2 |
| SF8 | all addressing + except 8SF 11sus all 0 sustain | 38.1 | cd/m2 | 10.3 | 1st sustain+ 10Normal sus for SF8 | 0.95 | cd/m2 |
| SF9 | all addressing + except 9SF 11sus all 0 sustain | 38.1 | cd/m2 | 10.3 | 1st sustain+ 10Normal sus for SF9 | 0.95 | cd/m2 |
| SF10 | all addressing + except 10SF 11sus all 0 sustain | 38.1 | cd/m2 | 10.3 | 1st sustain+ 10Normal sus for SF10 | 0.95 | cd/m2 |
| SF11 | all addressing + except 11SF 11sus all 0 sustain | 38.1 | cd/m2 | 10.3 | 1st sustain+ 10Normal sus for SF11 | 0.95 | cd/m2 |
| SF12 | all addressing + except 12SF 11sus all 0 sustain | 38.1 | cd/m2 | 10.3 | 1st sustain+ 10Normal sus for SF12 | 0.95 | cd/m2 |

Fig. 5
(a)
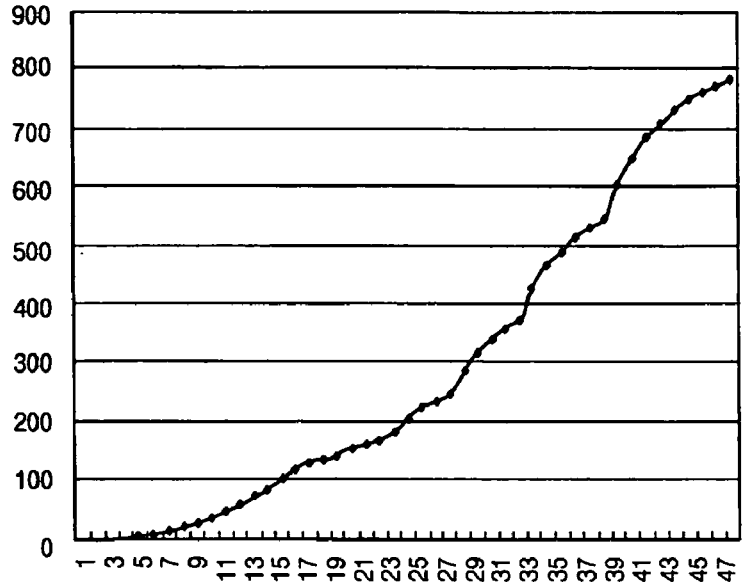
(b)
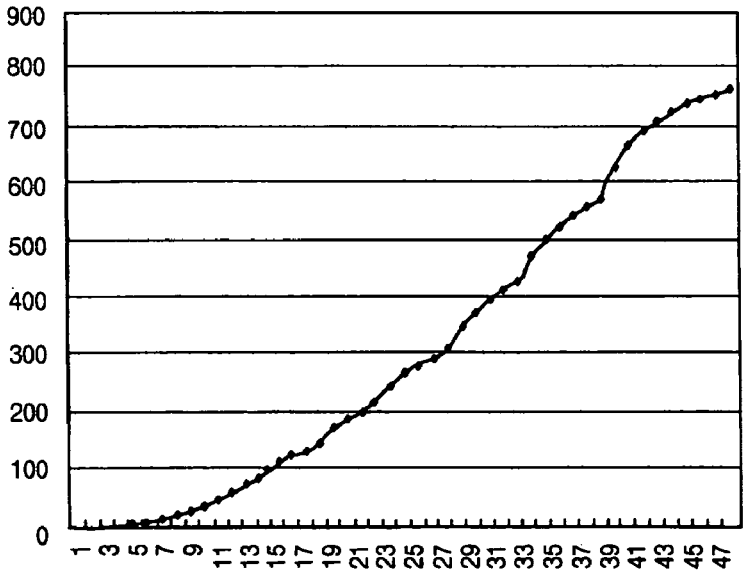

PLASMA DISPLAY APPARATUS AND IMAGE PROCESSING METHOD THEREOF

CROSS-REFERENCES TO RELATED APPLICATIONS

This Nonprovisional application claims priority under 35 U.S.C. §119(a) on Patent Application No. 10-2004-0034468 filed in Korea on May 14, 2004 the entire contents of which are hereby incorporated by reference.

BACKGROUND OF THE INVENTION

1. Field of the Invention

The present invention relates to a plasma display apparatus and image processing method thereof.

2. Background of the Related Art

Generally, in a plasma display panel (hereinafter, referred to as "PDP"), a barrier rib formed between a front glass and a rear glass, which are made of soda-lime glass, forms one unit cell. Each cell is filled with a main discharge gas, such as neon (Ne), helium (He) or a mixed gas (Ne+He) of Ne and He, and an inert gas containing a small amount of xenon. When the PDP is discharged by a high frequency voltage, the inert gas generates vacuum ultraviolet rays, and light-emits phosphors formed between the barrier ribs to implement an image.

Such a PDP can be easily fabricated since it has a simple structure compared to a cathode ray tube (CRT) that has been mainly used as the display means. Further, the PDP has characteristics that it can be made thin and large compared to the CRT, and has been spotlighted as a next-generation display apparatus.

FIG. 1 is a view for explaining gray level representation of a conventional PDP. As shown in FIG. 1, the three-electrode AC surface discharge type PDP is driven with one frame being divided into several sub-fields having a different number of emission in order to implement gray levels of an image.

Each of the sub fields is subdivided into a reset period for uniformly generating discharging, an address period for selecting a discharge cell, and a sustain period for implementing gray levels depending on the number of discharging of a sustain pulse. For example, if it is desired to display an image with 256 gray levels, a frame period (16.67 ms) corresponding to 1/60 seconds is divided into eight sub-fields SF1 to SF8, as shown in FIG. 1.

Each of the eight sub-fields SF1 to SF8 is subdivided into a reset period, an address period and a sustain period. At this time, the reset period and the address period of each of the sub-fields are the same every sub-field, but the sustain period of each of the sub-fields and the number of discharging of a sustain pulse increase in the ratio of $2^n$ (n=0, 1, 2, 3, 4, 5, 6, 7) in each sub-field. As such, as the sustain period is different in each sub-field, gray levels of an image can be represented.

FIG. 2 is a graph showing comparison results of brightness characteristics between a PDP and a CRT. As shown in FIG. 2, the CRT and LCD represent a desired gray level by controlling displayed light in analog mode according to an input video signal. Thus, they have non-linear brightness characteristics. In contrast, the PDP represents a gray level by modulating the number of light pulses using a matrix array of a discharge cell that can be turned on or off. It thus has linear brightness characteristics.

This method of representing the gray level of the PDP is called a "pulse width modulation (PWM) method". The brightness of the PDP varies linearly against the number of pulses. As the degree that is recognized by the naked eyes is non-linear, however, noise is generated when the gray level is represented in a low gray level region. Accordingly, in order to solve this problem, input video data undergo inverse gamma correction in the conventional PDP. That is, after a reference brightness value such as the CRT brightness curve of FIG. 2 is set, a gamma curve data LUT storage unit in which gamma curve data look-up table (LUT) corresponding to reference brightness values are stored is provided, and input gray level values undergo inverse gamma correction.

Meanwhile, the results of measuring real brightness values depending upon gray level values before the inverse gamma correction is shown in FIG. 3.

FIG. 3*a* is a table showing a mapping state of sub-fields depending upon gray level values of the conventional PDP. FIG. 3*b* is a graph showing the relationship between a real brightness value and a gray level value of the conventional PDP.

From FIG. 3*a*, it can be seen that when a gray level is represented by turning on/off a sub-field, the number of address discharge (a), which is additionally required to individually control each sub-field, as well as the sustain discharge (s) depending upon sub-field weight for representing the gray levels is different. That is, since light by a reset discharge (r) and the address discharge (a), which are additionally needed to individually control each sub-field, is displayed on a screen, a real brightness value depending upon a gray level value before inverse gamma correction does not increase linearly, as shown in FIG. 3*b*.

As such, a phenomenon in which a gray level having a lower gray level value, among neighboring gray levels, has a higher brightness value since it has a greater number of reset discharge and address discharge, is called an "inversion phenomenon of a gray level". In this case, there occurs a problem in that the linearity of a gray level for inverse gamma correction is not secured due to the inversion phenomenon.

SUMMARY OF THE INVENTION

Accordingly, the present invention has been made in view of the above problems occurring in the prior art, and it is an object of the present invention to provide a plasma display apparatus and image processing method thereof, wherein the linearity and representability of a gray level can be improved.

To achieve the above object, according to an aspect of the present invention, there is provided a plasma display apparatus, including an inverse gamma correction unit that subjects externally input data to inverse gamma correction using a gamma curve look-up table in which reference brightness value data depending upon gray level values and data corresponding to real brightness values displayed on a panel are stored; and a halftone unit that subjects the inverse gamma corrected data to dithering or error diffusion, thereby increasing the representability of gray levels.

According to the present invention, a plasma display apparatus and an image processing method thereof includes subjecting externally input data to inverse gamma correction using a gamma curve look-up table in which reference brightness value data depending upon gray level values and data corresponding to real brightness values displayed on a panel are stored, and subjecting dithering or error diffusion to the inverse gamma corrected data, thereby achieving a halftone process.

The gamma curve data stored in the gamma curve look-up table fulfill the following equation assuming that n is a predetermined gray level value, Re al(n) is a real brightness value depending upon the gray level value, and Re f(n) is a reference brightness value depending upon the gray level value.

$$\text{Gamma curve data} = \frac{Ref(n) - \text{Real}(n)}{\text{Real}(n+1) - \text{Real}(n)} + \text{Real(n)}$$

The halftone unit extracts $n^{th}$ and $(n+m)^{th}$ gray level values having the real brightness values, and generates gray levels of n+1, . . . , n+m−1 being intermediate values of the gray levels.

The real brightness values depending upon the gray level values are the brightness values that are directly measured using a brightness measurement apparatus when brightness values depending upon the gray level values are displayed on a panel.

The real brightness values depending upon the gray level values are found by measuring a brightness value of a reset period and an address period corresponding to each sub-field, measuring a brightness value corresponding to one pulse of a sustain period corresponding to each sub-field, and then using the measured values.

Assuming that each sub-field is SFM(a), the brightness value of the reset period and the address period corresponding to each sub-field is RA(a), the brightness value corresponding to one pulse of the sustain pulse corresponding to each sub-field is S(a), and the sustain weight depending upon a difference of the sustain period of each sub-field is Sη(a), the real brightness value fulfills the following equation:

$$\text{Real brightness value} = \Sigma(SFM(a)XRA(a) + SFM(a)XS\eta(a)XS(a))$$

BRIEF DESCRIPTION OF THE DRAWINGS

Further objects and advantages of the invention can be more fully understood from the following detailed description taken in conjunction with the accompanying drawings in which:

FIG. 4 is a table showing a real brightness value corresponding to each sub-field according to an embodiment of the present invention;

FIGS. 5(*a*) and 5(*b*) are graphs showing the relationship between real brightness values and gray level values according to an embodiment of the present invention;

DETAILED DESCRIPTION OF THE PREFERRED EMBODIMENT

The present invention will now be described in detail in connection with preferred embodiments with reference to the accompanying drawings.

FIG. 4 is a table showing a real brightness value corresponding to each sub-field according to an embodiment of the present invention.

As shown FIG. 4, brightness values of reset discharge, address discharge and sustain discharge corresponding to respective sub-fields can be viewed through measured values. That is, in an embodiment of the present invention, brightness values of a reset period and an address period corresponding to respective sub-fields are measured, and a brightness value corresponding to one pulse of a sustain period corresponding to each sub-field is measured. The measured values are then calculated to find real brightness values that are displayed on a panel after the gray level values undergoes inverse gamma correction.

In this case, the real brightness values can be found by substituting the measured values to the following equation 1.

$$\text{Real brightness value} = \Sigma(SFM(a)XRA(a) + SFM(a)XS\eta(a)XS(a)) \quad (1)$$

In this case, the parameters used in Equation 1 can be defined as follows.

SFM(a) indicates each sub-field.

RA(a) indicates the brightness value of the reset period and the address period corresponding to each sub-field.

S(a) indicates the brightness value corresponding to one pulse of the sustain pulse corresponding to each sub-field.

Sη(a) indicates the sustain weight depending upon a difference of the sustain period of each sub-field. That is, it indicates the gray level value to be represented depending upon the number of the sustain pulse of each sub-field.

FIG. 5 is a graph showing the relationship between real brightness values and gray level values according to an embodiment of the present invention. FIG. 5(*a*) is a graph showing the relationship of real brightness values according to gray level values, which are obtained by substituting the values of FIG. 4 to Equation 1. FIG. 5(*b*) is a graph showing the relationship of brightness values that are directly measured using a brightness measurement apparatus when gray level values are displayed on a panel. As shown in FIG. 5, the real brightness curves according to the gray level value can be obtained by finding the real brightness value through two methods.

Gamma curve data of the present invention depending upon a real brightness value will now be described in more detail with reference to FIG. 6 and Equation 2.

Figure 1:
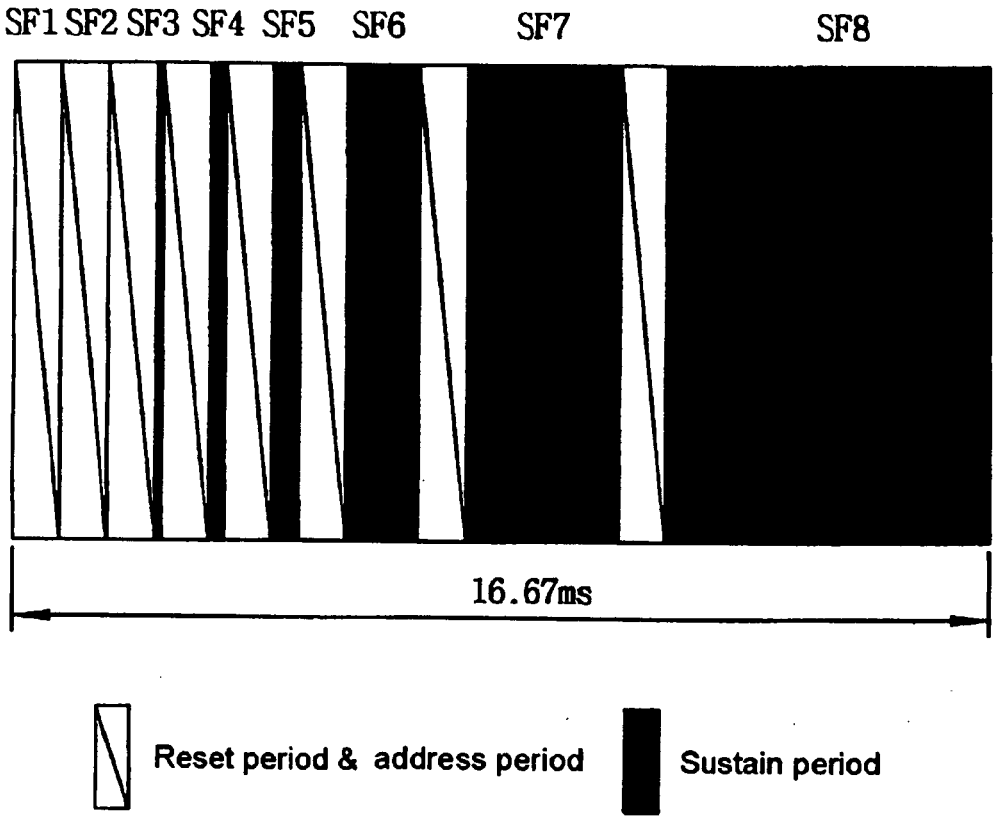
RELATED ART Fig. 1
FIG. 1 is a view for explaining gray level representation of a conventional PDP.
Figure 2:
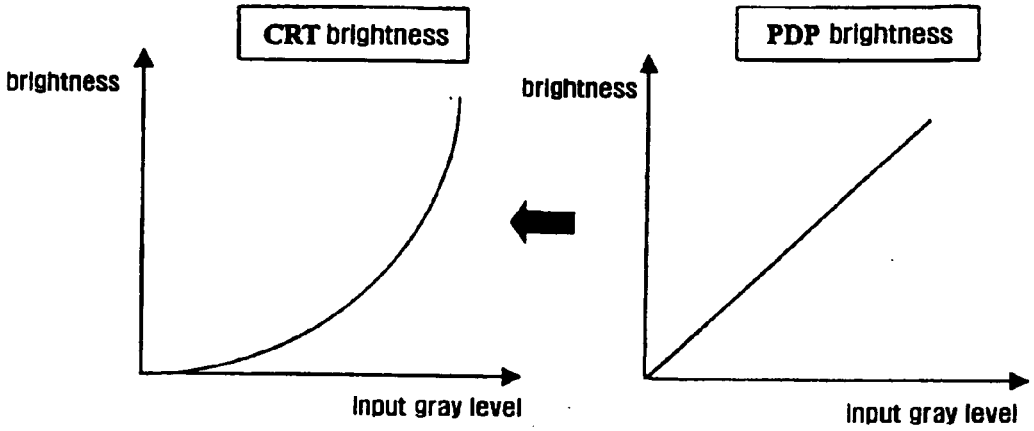
Fig. 2 RELATED ART
FIG. 2 is a graph showing comparison results of brightness characteristics between a PDP and a CRT.
Figures 3A, 3B:
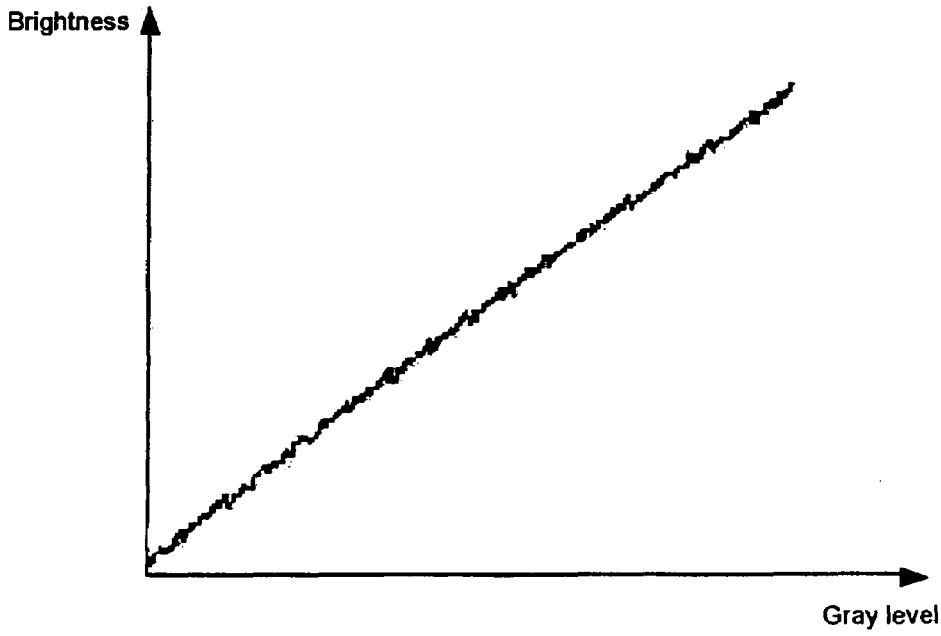
Fig. 3a RELATED ART
Fig. 3b RELATED ART
FIG. 3*a* is a table showing a mapping state of sub-fields depending upon gray level values of the conventional PDP.
FIG. 3*b* is a graph showing the relationship between a real brightness value and a gray level value of the conventional PDP.
Figure 6:
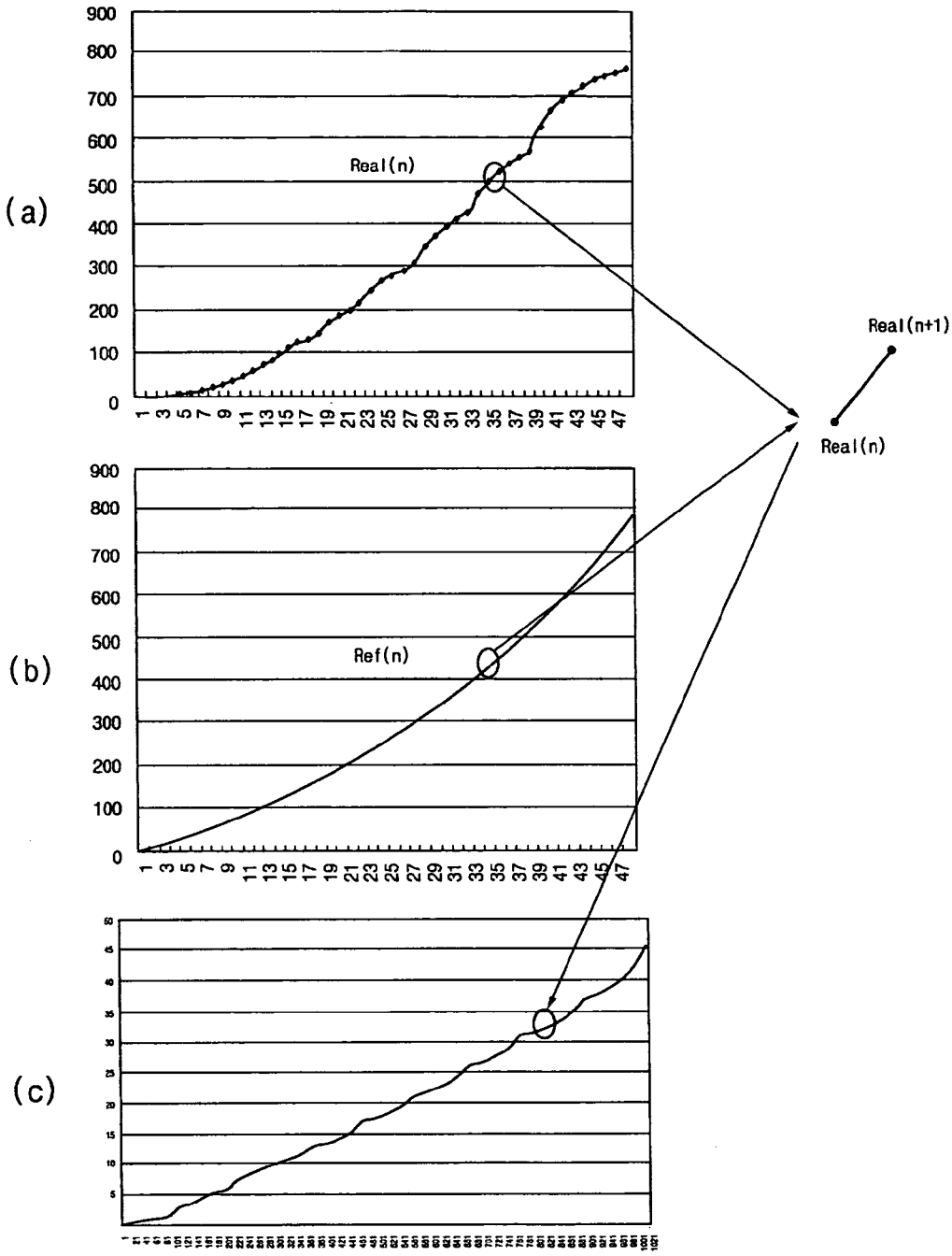
FIGS. 6(*a*) to 6(*c*) are graphs for explaining gamma curve data according to an embodiment of the present invention.

FIG. 6 is a graph for explaining gamma curve data according to an embodiment of the present invention. FIG. 6(*a*) is a graph showing real brightness values which are directly measured using the brightness measurement apparatus. FIG. 6(*b*) is a graph showing the reference brightness values shown in FIG. 2. FIG. 6(*c*) is a graph showing gamma curve data, which are found using the real brightness values and the reference brightness values. As shown in FIG. 6, gamma curve data can be obtained by substituting the reference brightness value shown in FIG. 2 and the real brightness value found in FIG. 5 to Equation 2.

$$\text{Gamma curve data} = \frac{Ref(n) - \text{Real}(n)}{\text{Real}(n+1) - \text{Real}(n)} + \text{Real(n)} \quad (2)$$

In this case, the parameters used in Equation 2 can be defined as follows.

n indicates a predetermined gray level value.

Re al(n) indicates the real brightness value depending upon the gray level value n.

Re f(n) indicates the reference brightness value depending upon the gray level value n.

In this case, a gray level representation apparatus includes a gamma curve data LUT storage unit in which gamma curve data are stored as LUT. The apparatus employs data of the gamma curve data LUT upon inverse gamma correction. As such, in the present invention, the linearity of a gray level can be improved by generating gamma curve data using real brightness values.

Meanwhile, in an embodiment of the present invention, the representability of gray levels can be improved using real brightness values. Detailed description thereof will be described with reference to FIG. 7.

Figure 7:
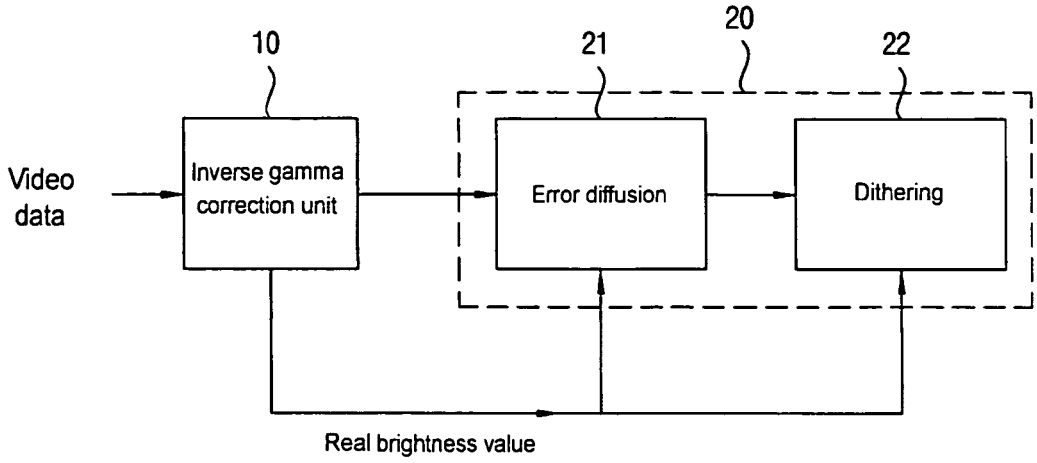
FIG. 7 is a block diagram for explaining generation of gray levels according to an embodiment of the present invention.

FIG. 7 is a block diagram for explaining generation of gray levels according to an embodiment of the present invention.

As shown in FIG. 7, a gray level representation apparatus according to an embodiment of the present invention includes a half tone unit 20 that performs error diffusion 21 or dithering 22 on video data which undergo inverse gamma correction through an inverse gamma correction unit 10, thereby increasing the representability of gray levels. In this case, one of both dithering and error diffusion can be used.

In dithering, whether a carry has occurred is determined when it is higher than or the same as a predetermined threshold value every pixel through a dither mask. The representability of a short gray level is increased by turning on pixels in which a carry is generated and turning off pixels in which a carry is not generated.

Error diffusion is a method in which correction for discarded error is spatially solved by allowing error generated when a corresponding pixel is quantized to affect neighboring pixels.

In this case, the half tone unit 20 extracts $n^{th}$ and $(n+m)^{th}$ gray levels having the real brightness value in FIG. 5, and then generates gray levels of n+1, . . . , n+m−1 being intermediate values of the gray levels using dithering or error diffusion. It is thus possible to improve the representability of gray levels using real brightness values.

As described above, according to the present invention, before externally input picture data undergo inverse gamma correction, the linearity of gray levels is secured. Thus, the present invention has an effect in that it can improve the representability of gray levels after inverse gamma correction.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

an inverse gamma correction unit subjecting video data to inverse gamma correction using gamma curve data stored in a gamma curve look-up table, the gamma curve data generated by using reference brightness values and real brightness values; and a halftone unit for dithering or performing error diffusion on the inverse gamma corrected video data, wherein the gamma curve data stored in the gamma curve look-up table satisfy the following equation assuming that n is a predetermined gray level value, Re al(n) is a real brightness value depending upon the gray level value, and Re f(n) is a reference brightness value depending upon the gray level value:

$$\text{Gamma curve data} = \frac{Ref(n) - \text{Real}(n)}{\text{Real}(n+1) - \text{Real}(n)} + \text{Real}(n).$$

2. The plasma display apparatus as claimed in claim 1, wherein the halftone unit extracts $n^{th}$ and $(n+m)^{th}$ gray level values having the real brightness values, and generates gray levels of n+1, . . . , n+m−1 which is intermediate values of the gray levels.

3. The plasma display apparatus as claimed in claim 1, wherein the real brightness values used to generate the gamma curve data are directly measured using a brightness measurement apparatus when gray level values are displayed on a panel.

4. The plasma display apparatus as claimed in claim 1, wherein the real brightness values used to generate the gamma curve data are found by measuring a brightness value of a reset period and an address period corresponding to each sub-field, and by measuring a brightness value corresponding to one pulse of a sustain period corresponding to each sub-field.

5. The plasma display apparatus as claimed in claim 4, wherein assuming that each sub-field is SFM(a), the brightness value of the reset period and the address period corresponding to each sub-field is RA(a), the brightness value corresponding to one pulse of the sustain pulse corresponding to each sub-field is S(a), and the sustain weight depending upon a difference of the sustain period of each sub-field is Sη(a), the real brightness value fulfills the following equation:

$$\text{Real brightness value} = \Sigma(SFM(a) X RA(a) + SFM(a) X S\eta(a) X S(a)).$$

6. An image processing method of a plasma display apparatus, comprising the steps of:

subjecting video data to inverse gamma correction using gamma curve data stored in a gamma curve look-up table, the gamma curve data generated by using reference brightness values and real brightness values; and performing halftoning by dithering or error diffusion on the inverse gamma corrected video data, wherein the gamma curve data stored in the gamma curve look-up table fulfill the following equation assuming that n is a predetermined gray level value, Re al(n) is a real brightness value depending upon the gray level value, and Re f(n) is a reference brightness value depending upon the gray level value:

$$\text{Gamma curve data} = \frac{\text{Re } f(n) - \text{Re } al(n)}{\text{Re } al(n+1) - \text{Re } al(n)} + \text{Re } al(n).$$

7. The image processing method as claimed in claim 6, wherein the dithering or error diffusion includes the steps of:

extracting $n^{th}$ and $(n+m)^{th}$ gray level values having the real brightness values; and generating gray levels of n+1, . . . , n+m−1 being intermediate values of the gray levels using the extracted $n^{th}$ and $(n+m)^{th}$ gray level values.

8. The image processing method as claimed in claim 6, wherein the real brightness values used to generate the gamma curve data are directly measured using a brightness measurement apparatus when gray level values are displayed on a panel.

9. The image processing method as claimed in claim 6, wherein the real brightness values used to generate the gamma curve data are found by measuring a brightness value of a reset period and an address period corresponding to each sub-field, measuring a brightness value corresponding to one pulse of a sustain period corresponding to each sub-field, and then using the values measured in the reset period, the address period and the sustain period for obtaining the real brightness values.

10. The image processing method as claimed in claim 9, wherein assuming that each sub-field is SFM(a), the brightness value of the reset period and the address period corresponding to each sub-field is RA(a), the brightness value corresponding to one pulse of the sustain pulse corresponding to each sub-field is S(a), and the sustain weight depending upon a difference of the sustain period of each sub-field is Sη(a), the real brightness value fulfills the following equation:

$$\text{Real brightness value}=\Sigma(SFM(a)XRA(a)+SFM(a)XS\eta(a)XS(a)).$$

* * * * *